US010800635B2

(12) United States Patent
Nanjappan

(10) Patent No.: US 10,800,635 B2
(45) Date of Patent: Oct. 13, 2020

(54) ELEVATOR DOOR WEDGE MONITORING SYSTEM

(71) Applicant: Otis Elevator Company, Farmington, CT (US)

(72) Inventor: Ezhil Nanjappan, Farmington, CT (US)

(73) Assignee: OTIS ELEVATOR COMPANY, Famington, CT (US)

( * ) Notice: Subject to any disclaimer, the term of this patent is extended or adjusted under 35 U.S.C. 154(b) by 449 days.

(21) Appl. No.: 15/691,276

(22) Filed: Aug. 30, 2017

(65) Prior Publication Data

US 2019/0062108 A1 Feb. 28, 2019

(51) Int. Cl.

| | |
|---|---|
| ***E05C 17/54*** | (2006.01) |
| ***B66B 5/00*** | (2006.01) |
| ***G08B 21/18*** | (2006.01) |

(52) U.S. Cl.

CPC ..... *B66B 5/005* (2013.01); *B66B 5/0087* (2013.01); *E05C 17/54* (2013.01); *G08B 21/18* (2013.01); *E05Y 2201/218* (2013.01); *E05Y 2400/66* (2013.01); *E05Y 2900/104* (2013.01)

(58) Field of Classification Search

CPC ..... B66B 5/005; B66B 5/0043; B66B 5/00; E05C 17/54; E05C 17/047; G08B 21/18; G08B 21/02; G08B 21/182; E05Y 2201/218; E05Y 2201/00; E05Y 2400/66; E05Y 2400/664; E05Y 2900/104;

(Continued)

(56) References Cited

U.S. PATENT DOCUMENTS 5,008,648 A * 4/1991 Conemac ..... G08B 13/08 200/61.62

5,697,656 A 12/1997 Hebert et al.

(Continued)

FOREIGN PATENT DOCUMENTS

CN 203529637 U 4/2014
CN 205558529 U 9/2016

(Continued)

OTHER PUBLICATIONS

The Extended European Searach Report for Application No. 18190504.4-1017; Report dated Feb. 11, 2019; Report dated Feb. 13, 2019; 6 pages.

(Continued)

*Primary Examiner* — Nathan Cumar
(74) *Attorney, Agent, or Firm* — Cantor Colburn LLP

(57) ABSTRACT

An elevator door wedge monitoring system is provided. The elevator door wedge monitoring system comprising: an engagement sensing system configured to detect an engagement parameter, wherein the engagement parameter indicates whether an elevator door wedge is properly engaged with an elevator door; a communication device in electronic communication with the engagement sensing system and configured to receive the engagement parameter from the engagement sensing system; and an application installed on a user device in wireless communication with the communication device; wherein the communication device is configured to transmit the engagement parameter to the application.

20 Claims, 4 Drawing Sheets

(58) Field of Classification Search
CPC ..... E05Y 2900/00; E05Y 2900/10; E05Y 2900/102; E05Y 2900/106
USPC ..... 292/343
See application file for complete search history.

(56) References Cited

U.S. PATENT DOCUMENTS

| | | | | |
|---|---|---|---|---|
| 6,727,805 | B2 * | 4/2004 | Hollister | E05C 17/54 292/342 |
| 7,426,981 | B2 * | 9/2008 | Bacellar | B66B 1/34 187/247 |
| 7,907,052 | B2 | 3/2011 | Delaney, Jr. | |
| 8,042,846 | B2 | 10/2011 | Ruggerio | |
| 8,556,043 | B2 | 10/2013 | Mangini et al. | |
| 9,027,972 | B2 | 5/2015 | Muramatsu et al. | |
| 9,213,473 | B2 | 12/2015 | Hovi et al. | |
| 9,403,663 | B2 | 8/2016 | Dellarippa et al. | |
| 2009/0113672 | A1 * | 5/2009 | Ibey | A62B 3/00 16/404 |
| 2014/0076667 | A1 | 3/2014 | Henseler | |
| 2015/0019340 | A1 * | 1/2015 | El-Masri | G06Q 30/0265 705/14.62 |
| 2016/0047149 | A1 | 2/2016 | Bertelli et al. | |
| 2016/0106174 | A1 | 4/2016 | Chung et al. | |
| 2016/0186470 | A1 * | 6/2016 | Finley | E05C 19/18 292/339 |
| 2017/0137256 | A1 | 5/2017 | Meguro et al. | |

FOREIGN PATENT DOCUMENTS

| | | | |
|---|---|---|---|
| JP | H02295868 | A | 12/1990 |
| JP | 2005132543 | A | 5/2005 |
| JP | 2014133619 | A | 7/2014 |
| WO | 9811082 | A1 | 3/1998 |
| WO | 2006076818 | A1 | 7/2006 |
| WO | 2007018540 | A | 2/2007 |
| WO | 2008072023 | A1 | 6/2008 |
| WO | 2016057578 | A1 | 4/2016 |

OTHER PUBLICATIONS

Aoli Wholesale Center, "Door Stop Wedge Alarm for Home and Travel", available at: http://www.allspycameras.com/product/en/china-Door-Stop-Wedge-Alarm-for-Home-Travel.html, 4pgs.

Havenlock, "Haven: The Stronger Smarter Home Lock—Haven Lock" available at: https://havenlock.com/, accessed Aug. 28, 2017, 7pgs.

* cited by examiner

ELEVATOR DOOR WEDGE MONITORING SYSTEM

BACKGROUND

The subject matter disclosed herein generally relates to the field of elevator door wedges, and more particularly to an apparatus and method for determining a status of the elevator door wedge.

Elevator door wedges help protect elevator technicians but must be properly used.

BRIEF SUMMARY

According to one embodiment, an elevator door wedge monitoring system is provided. The elevator door wedge monitoring system comprising: an engagement sensing system configured to detect an engagement parameter, wherein the engagement parameter indicates whether an elevator door wedge is properly engaged with an elevator door; a communication device in electronic communication with the engagement sensing system and configured to receive the engagement parameter from the engagement sensing system; and an application installed on a user device in wireless communication with the communication device; wherein the communication device is configured to transmit the engagement parameter to the application.

In addition to one or more of the features described above, or as an alternative, further embodiments may include that the wireless communication is Bluetooth.

In addition to one or more of the features described above, or as an alternative, further embodiments may include that the application on the user device is configured to transmit the engagement parameter to an application on a manager device.

In addition to one or more of the features described above, or as an alternative, further embodiments may include that the application on the user device is configured to activate an alarm on the user device when the engagement parameter indicates that the elevator door wedge is not properly engaged.

In addition to one or more of the features described above, or as an alternative, further embodiments may include that the application on the user device is configured to detect a location parameter of the user device.

In addition to one or more of the features described above, or as an alternative, further embodiments may include that the application on the user device is configured to activate an alarm on the user device when the location parameter is within a selected radius of a selected location and the engagement parameter indicates that the elevator door wedge is not properly engaged.

In addition to one or more of the features described above, or as an alternative, further embodiments may include that the application on the user device is configured to display an elevator door wedge status in response to the engagement parameter.

In addition to one or more of the features described above, or as an alternative, further embodiments may include that the application on the manager device is configured to display an elevator door wedge status in response to the engagement parameter.

In addition to one or more of the features described above, or as an alternative, further embodiments may include that the application on the user device is configured to display instructions in response to the engagement parameter, the instructions depicting proper engagement of an elevator door wedge and an elevator door.

In addition to one or more of the features described above, or as an alternative, further embodiments may include that the application on the manager device is configured to activate an alarm on the manager device when the engagement parameter indicates that the elevator door wedge is not properly engaged.

According to another embodiment, a method of monitoring elevator door wedge usage is provided. The method comprising: detecting, using an engagement sensing system, an engagement parameter, wherein the engagement parameter indicates whether an elevator door wedge is properly engaged with an elevator door; receiving, using a communication device, the engagement parameter from the engagement sensing system, the communication device being in electronic communication with the engagement system; and transmitting, using the communication device, the engagement parameter to an application installed on a user device in wireless communication with the communication device.

In addition to one or more of the features described above, or as an alternative, further embodiments may include: transmitting, using the application installed on the user device, the engagement parameter to an application installed on a manager device.

In addition to one or more of the features described above, or as an alternative, further embodiments may include: activating, using the application installed on the user device, an alarm on the user device when the engagement parameter indicates that the elevator door wedge is not properly engaged.

In addition to one or more of the features described above, or as an alternative, further embodiments may include: detecting, using the application installed on the user device, a location parameter of the user device.

In addition to one or more of the features described above, or as an alternative, further embodiments may include: activating, using the application installed on the user device, an alarm on the user device when the location parameter is within a selected radius of a selected location and the engagement parameter indicates that the elevator door wedge is not properly engaged.

In addition to one or more of the features described above, or as an alternative, further embodiments may include: displaying, using the application installed on the user device, an elevator door wedge status in response to the engagement parameter.

In addition to one or more of the features described above, or as an alternative, further embodiments may include: displaying, using the application installed on the manager device, an elevator door wedge status in response to the engagement parameter.

In addition to one or more of the features described above, or as an alternative, further embodiments may include: displaying, using the application installed on the user device, instructions in response to the engagement parameter, the instructions depicting proper engagement of an elevator door wedge and an elevator door.

In addition to one or more of the features described above, or as an alternative, further embodiments may include: activating, using the application installed on the manager device, an alarm on the manager device when the engagement parameter indicates that the elevator door wedge is not properly engaged.

According to another embodiment, an elevator door wedge is provided. The elevator door wedge comprising: an upper jaw; a lower jaw operably connected to the upper jaw;

an adjustment mechanism configured to adjust a distance between the upper jaw and the lower jaw; an engagement sensing system configured to detect an engagement parameter, wherein the engagement parameter indicates whether an elevator door wedge is properly engaged with an elevator door; and a communication device in electronic communication with the engagement sensing system and configured to receive the engagement parameter from the engagement sensing system.

Technical effects of embodiments of the present disclosure include monitoring an engagement parameter of an elevator door wedge and transmitting the engagement parameter to a user device in short-range wireless connection with the elevator door wedge.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
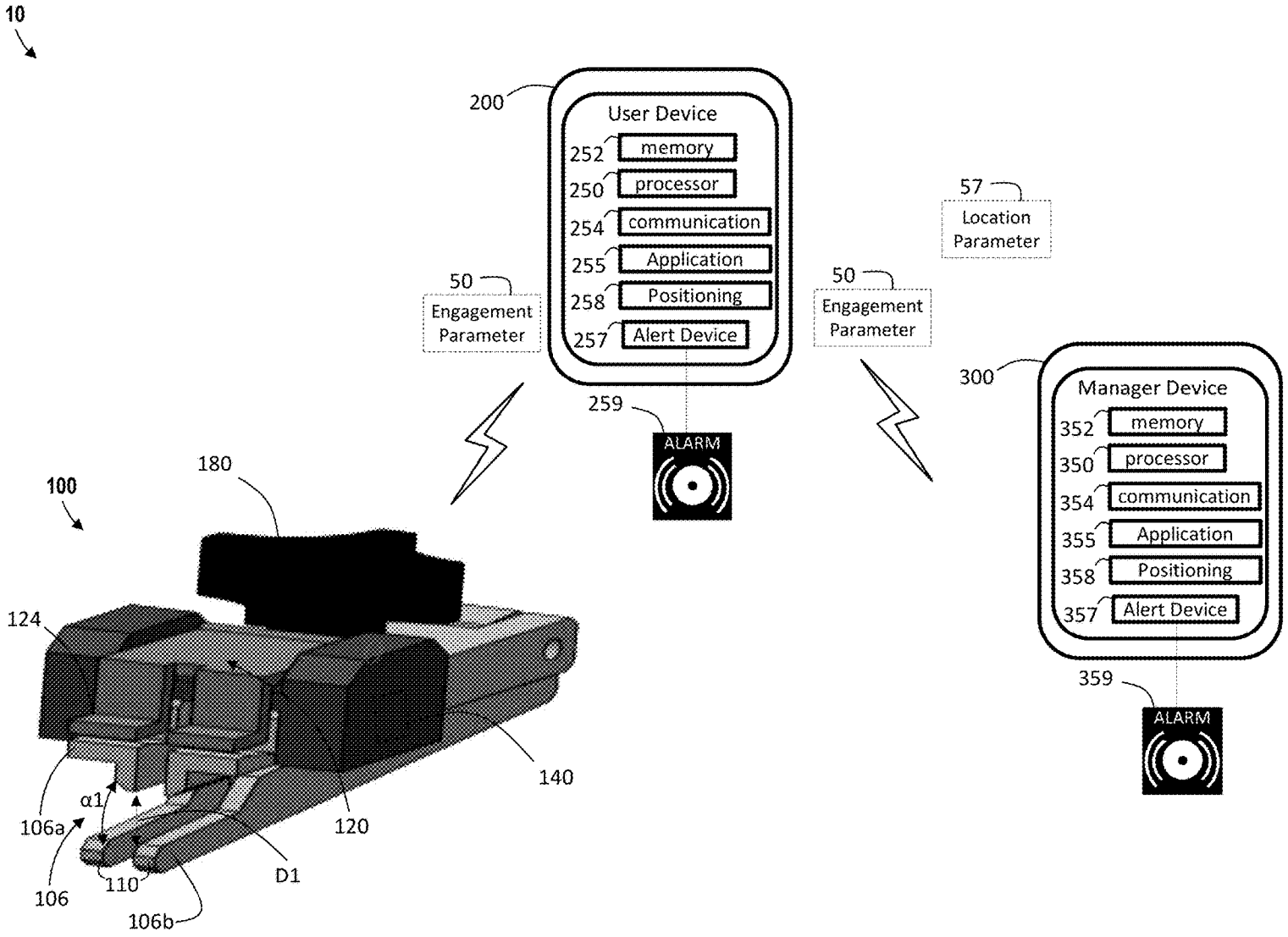
FIG. 1 illustrates a schematic view of elevator door wedge monitoring system, in accordance with an embodiment of the disclosure.

Referring now to FIG. 1, which depicts an elevator door wedge monitoring system 10 in an example embodiment. The elevator door wedge monitoring system 10 includes one or more elevator door wedges 100, a user device 200, and a manager device 300. The user device 200 is capable of secure bi-directional communication with the elevator door wedge 100 and the manager device 300. The communication may occur over a wireless network, such as 802.11x (Wi-Fi), short-range radio, cellular, satellite, etc. The user device 200 may be a mobile computing device that is typically carried by a person, such as, for example a phone, PDA, smart watch, tablet, laptop, etc. The user device 200 may include a processor 250, memory 252, and communication module 254, as shown in FIG. 1. The processor 250 can be any type or combination of computer processors, such as a microprocessor, microcontroller, digital signal processor, application specific integrated circuit, programmable logic device, and/or field programmable gate array. The memory 252 is an example of a non-transitory computer readable storage medium tangibly embodied in the user device 200 including executable instructions stored therein, for instance, as firmware. The communication module 254 may implement one or more communication protocols as described in further detail herein. The user device 200 may also include a positioning system 258 configured to determine a location of the user device 200. The positioning system 258 may include but is not limited to a GPS system, a wireless signal triangulation system, a beacon system, and/or a cellular signal triangulation system. The position system 258 may be configured to determine a location parameter 57 of at least one of the user device 200 and the elevator door wedge 100. The user device 200 may include an alert device 257 configured to activate an alarm 259. In three non-limiting examples, the alert device 257 may be a vibration motor, audio speaker, and/or display screen. The alarm 259 may be audible, visual, haptic, and/or vibratory. The user device 200 may also include an application 255. Embodiments disclosed herein, may operate through the application 255 installed on the user device 200, discussed further below. In a non-limiting example, the user device 200 may belong to an employee, such as, for example, an elevator technician.

The manager device 300 is capable of secure bi-directional communication with the user device 200. The communication may occur over a wireless network, such as 802.11x (Wi-Fi), short-range radio, cellular, satellite, etc. The manager device 300 may be a computing device such as a desktop computer. The manager device 300 may also be a mobile computing device that is typically carried by a person, such as, for example a phone, PDA, smart watch, tablet, laptop, etc. The manager device 300 may also be two separate devices that are synced together such as, for example, a cellular phone and a desktop computer synced over an internet connection. The manager device 300 may include a processor 350, memory 352, and communication module 354, as shown in FIG. 1. The processor 350 can be any type or combination of computer processors, such as a microprocessor, microcontroller, digital signal processor, application specific integrated circuit, programmable logic device, and/or field programmable gate array. The memory 352 is an example of a non-transitory computer readable storage medium tangibly embodied in the manager device 300 including executable instructions stored therein, for instance, as firmware. The communication module 354 may implement one or more communication protocols as described in further detail herein. The manager device 300 may also include a positioning system 358 configured to determine a location of the manager device 300. The positioning system 358 may include but is not limited to a GPS system, a wireless signal triangulation system, a beacon system, and/or a cellular signal triangulation system. The manager device 300 may include an alert device 357 configured to activate an alarm 359. In three non-limiting examples, the alert device 357 may be a vibration motor, audio speaker, and/or display screen. The alarm 359 may be audible, visual, haptic, and/or vibratory. The manager device 300 may also include an application 355. Embodiments disclosed herein, may operate through the application 355 installed on the manager device 300, discussed further below. In a non-limiting example, the manager device 300 may belong to a manager or supervisor of the employee carrying the user device 200.

Figure 2B:
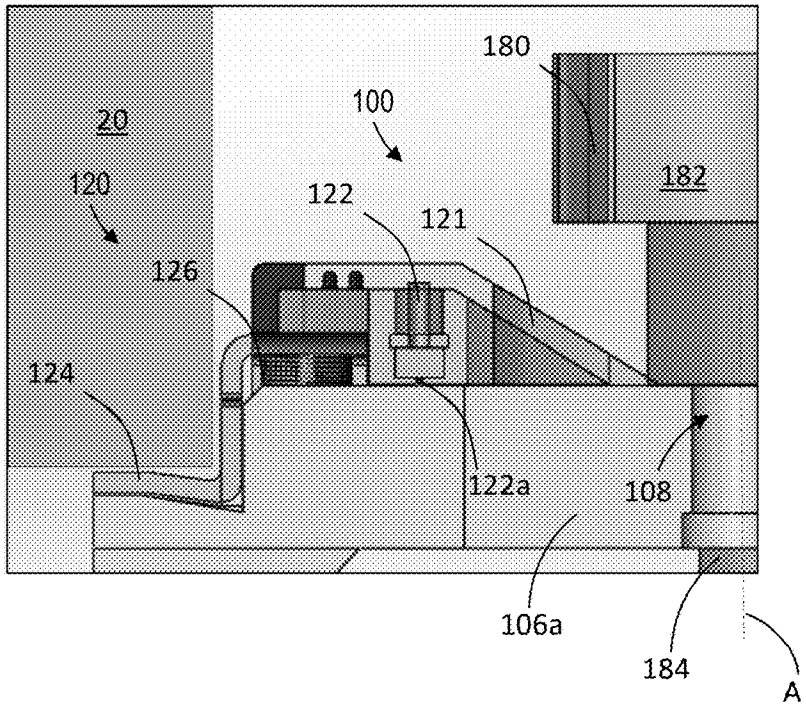
FIG. 2*b* illustrates a schematic view of elevator door wedge, in accordance with an embodiment of the disclosure.
Figure 2A:
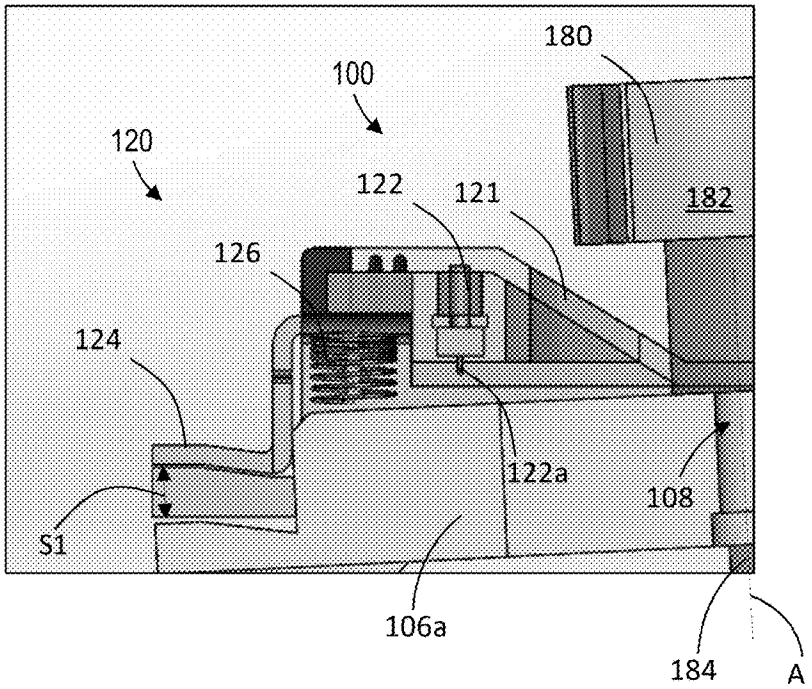
FIG. 2*a* illustrates a schematic view of elevator door wedge, in accordance with an embodiment of the disclosure.

Referring now to FIGS. 1, 2*a*, and 2*b*. The elevator door wedge 100 may be utilized by elevator technicians in order to secure an elevator door 20 in an open position so that the technician may perform repairs and/or upgrades to an elevator car. The elevator door wedge 100 may be composed of a jaw 106 (*a, b*), an adjustment mechanism 180, an engagement sensing system 120, and a communication device 140. It is understood that the elevator door wedge 100 may include more or less components than illustrated in FIGS. 1, 2*a*, and 2*b* and that the specific design is merely exemplary.

The engagement sensing system 120 is configured to detect an engagement parameter 50 of the elevator door wedge 100. The engagement parameter 50 may indicate whether the elevator door wedge 100 is properly engaged with an elevator door 20. FIG. 2*a* shows the elevator door wedge 100 disengaged and FIG. 2*b* shows the elevator door wedge 100 engaged with an elevator door 20. In order to engage the elevator door wedge 100 with the elevator door 20, an elevator technician adjusts the adjustment mechanism 180, which is configured to adjust the distance D1 between an upper jaw 106*a* of the jaw 106 and a lower jaw 106*b* of the jaw 106. As seen in FIG. 1, the lower jaw 106*b* may include tracks 110 to engage with tracks (not shown) of an elevator car door 20. The upper jaw 106*a* may also engage the tracks of an elevator door 20 when the adjustment mechanism 180 fully closes the jaw 106. While an engagement arm 124 is shown engaging an elevator door 20, the upper jaw 106*a* may also engage the elevator door 20 in alternate embodiments. In the embodiment disclosed, the upper jaw 106*a* may be at oriented at a first angle $\alpha$1 relative to the lower jaw 106*b*. Further, as an elevator technician adjusts the adjustment mechanism 180 the first angle $\alpha$1 will adjust.

In the illustrated embodiment, the adjustment mechanism 180 includes an adjustment knob 182 securely connected to a threaded screw 184. Further, the threaded screw 184 is rotatably connected to the lower jaw 106*a* such that as the adjustment knob 182 is rotated, the screw 184 will spin within the lower jaw 106 but the lower jaw 106*b* will not move relative to an axis A of the threaded screw 184. The upper jaw 106*a* is operably connected to the threaded screw 184 through internal threads 108 located within the upper jaw 106*a*. The internal threads 108 mate with threads (not shown) on the threaded screw 184 such that as the adjustment knob 182 is rotated, the screw 184 will spin and the upper jaw 106*a* will move along the axis A of the screw 184 either towards the lower jaw 106*b* or away from the lower jaw 106*b* depending upon the direction of rotation of the adjustment knob 182.

The engagement sensing system 120 is composed of a lever arm 121, an engagement arm 124, a biasing mechanism 126, and a sensing device 122. The engagement arm 124, the biasing mechanism 126, and the sensing device 122 are each operably attached to the lever arm 121. The lever arm 121 is cantilevered over the upper jaw 106*a*. When the elevator door wedge 100 is disengaged with the door 20, the biasing mechanism 126 maintains a separation S1 between the lever arm 121 and the upper jaw 106*a*, as seen in FIG. 2*a*. The separation S1 ensures that the sensing device 122 does not come in contact with the upper jaw 106*a*, which would trigger the sensing device 122. In an embodiment, the sensing device 122 may be a solenoid sensor. The biasing mechanism 126 may be a spring in a non-limiting example. When the elevator door wedge 100 is engaged with the door, the biasing mechanism 126 is compressed and the sensing device 122 is in contact with the upper jaw 106*a*, which depresses a sensing plunger 122*a*, as seen in FIG. 2*b*. When the sensing device 122 is in contact with the upper jaw 106*a*, it is indicative that the elevator door wedge 100 is properly engaged with the elevator door 20. Thus, when the sensing device 122 is in contact with the upper jaw 106*a*, the sensing device 122 is configured to communicate an engagement parameter 50 to the communication device 140 indicating that the elevator door wedge 100 is properly engaged. The engagement sensing system 120 may also be in electronic communication with the adjustment mechanism 180 to detect when the adjustment mechanism 180 has been activated to install the elevator door wedge 100 but the elevator door wedge 100 is not properly engaged. It is understood that the proper engagement of the elevator door wedge 100 may be detected differently than described herein and that the specific design is not intended to be limiting.

The communication device 140 is in electronic communication with the engagement sensing system 120 and more specifically with the sensing device 122. The communication device 140 is also in wireless communication with the user device 200. The wireless communication may be short-range wireless communication such as for example 802.11x (Wi-Fi), short-range radio, Bluetooth, and/or any other type of communication known to one of skill in the art. In an embodiment the short-range wireless communication is Bluetooth. The communication device 140 is configured to transmit an engagement parameter 50 detected by the engagement sensing system 120 to the user device 200. The communication device 140 may be configured to transmit the engagement parameter 50 periodically at a selected frequency or when the engagement parameter 50 changes. The communication device 140 may also include a power device (not shown) configured to provide power to the communication device 140.

The engagement parameter 50 may be displayed on the user device 200 when received from the communication device 140. The alarm 259 may be activated on the user device 200 when the engagement parameter 50 is received. When an engagement parameter 50 is received by the user device 200, the engagement parameter 50 may be optionally transmitted to the manager device 300. The manager may wish to keep track of whether their elevator technicians are properly utilizing the elevator door wedges 100. Further, the engagement parameter 50 may be displayed on the manager device 300 when received from the user device 200. The alarm 359 may be activated on the manager device 300 when the engagement parameter 50 is received. Further, an alarm 359 may also be activated on the manager device 300 if the elevator technician is detected to enter an elevator shaft with the elevator door wedge 100 improperly engaged or not installed.

Figure 3:
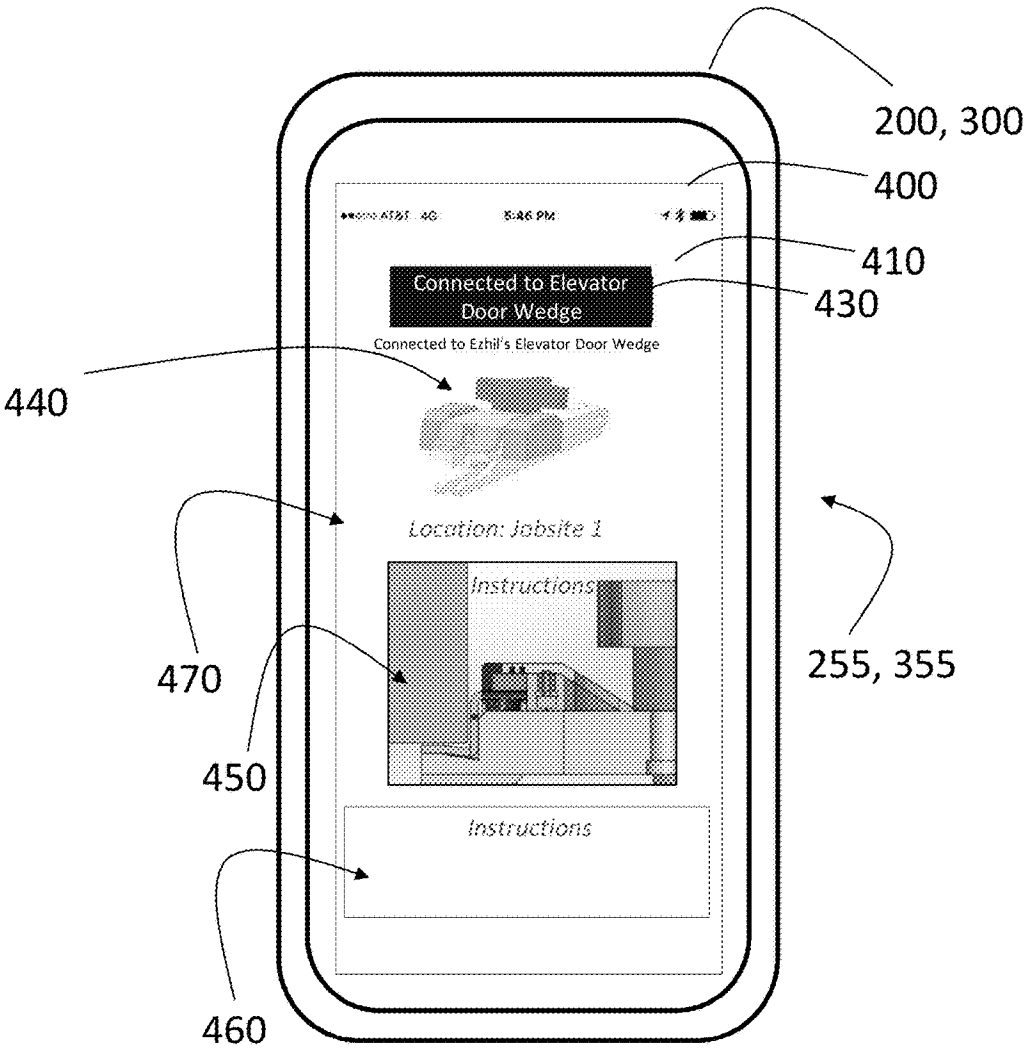
FIG. 3 depicts a user interface on a device, in accordance with an embodiment of the disclosure.

Referring now to FIG. 3 with continued reference to FIGS. 1, 2*a* and 2*b*. FIG. 3 depicts an example user interface 400 on either the user device 200 or the manager device 300 through the respective application 255, 355. It is understood that the application 255 on the user device 200 may be the same application 355 that is installed on the manager device 300, thus the two applications 255, 355 may share a common user interface 400 illustrated in FIG. 3. When using the application 255, 355 the user interface 400 may display a status screen 410, as shown in FIG. 3. The status screen 410 may display a connection status 430, an elevator door wedge status 440, a location status 470, and instructions 450, 460.

The connection status 430 depicts whether the user device 200 is connected to the communication device 140 of the elevator door wedge 100. The elevator door wedge status 440 depicts the engagement parameter 50 detected by the engagement sensing system 120. For example, an elevator technician may want to know if the elevator door wedge 100 is properly engaged, thus an engagement parameter 50 may be transmitted from the communication device 140 to the user device 200 and viewed on the user device 200 via elevator door wedge status 440. The engagement parameter 50 may be transmitted automatically to the user device 200 and/or at the request of user device 200. In another example, a manager of the elevator technician may want to know if their technician's elevator door wedge 100 is properly engaged, thus an engagement parameter 50 may be transmitted from the user device 200 to the manager device 300 and viewed on the manager device 300 via elevator door wedge status 440. In another example, if the engagement sensing system 120 detects that the elevator door wedge 100 is properly engaged then the elevator door wedge status 440 may illuminate a green symbol, which is an elevator door wedge in FIG. 3. However, if the engagement sensing system 120 detects that the elevator door wedge 100 is not properly engaged then the elevator door wedge status 440 may illuminate a red or a faded gray. It is important to note that text may be utilized for the door wedge status 440 in lieu of a symbol. If the elevator door wedge status 440 indicates that the elevator door wedge 100 is not properly engaged then instructions 450, 460 may be displayed within the status screen 410 so that the technician or manager may be reminded of how to properly engage the elevator door wedge 100 with the elevator door 20. The instructions may be visual instructions 450 showing pictures and/or videos of how the elevator door wedge 100 should be properly engaged with the elevator door 20. The instructions may also be textual instructions 460 showing text describing how the elevator door wedge 100 should be properly engaged. The instructions may also be audio instructions describing how the elevator door wedge 100 should be properly engaged.

The location status 470 depicts a location parameter 57 of the user device 200. In an example, the location status 470 may state the jobsite where the user device is located. In another example, the location status 470 may state the geographical location of the user device 200. In yet another example, the location status 470 may depict whether the user device 200 is within an elevator shaft. Advantageously, an alarm 259 may activate on the user device 200 if the user device 200 has entered the elevator shaft and the elevator door wedge 100 is not properly engaged.

Figure 4:
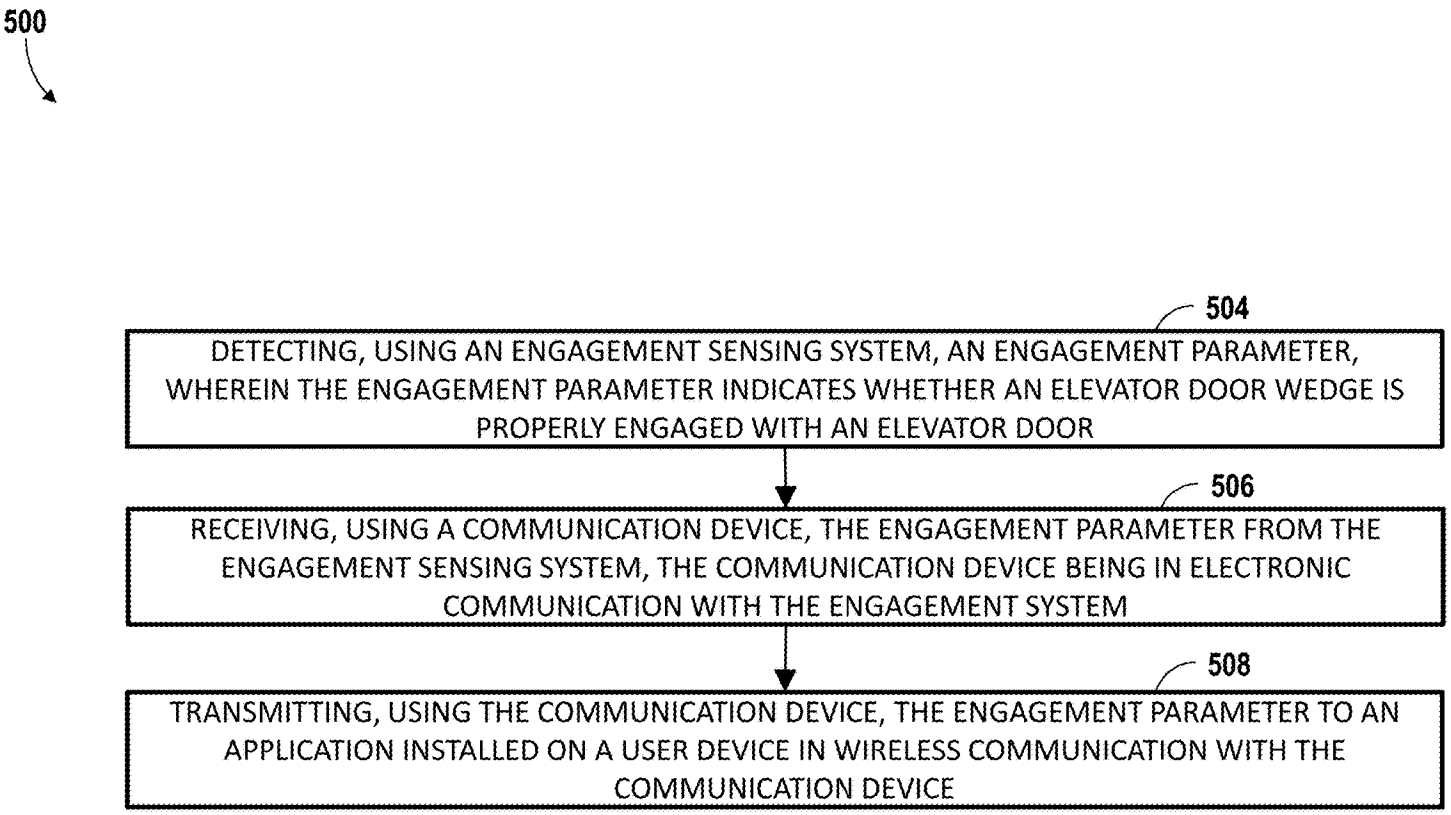
FIG. 4 is a flow diagram illustrating a method of monitoring elevator door wedge usage, according to an embodiment of the present disclosure.

Referring now to FIG. 4, while referencing components of FIGS. 1-3. FIG. 4 shows a flow chart of method 500 of monitoring elevator door wedge 100 usage, in accordance with an embodiment of the disclosure. At block 504, an engagement sensing system 120 detects an engagement parameter 50 that indicates whether the elevator door wedge 100 is properly engage with an elevator door 20 by detecting a distance (e.g., separation S1 of FIG. 2A) between an upper jaw 106*a* of the elevator door wedge 100 and the engagement arm 124 of the engagement sensing system 120. At block 506, a communication device 140 receives the engagement parameter 50 from the engagement sensing system 120. The communication device 140 is in electronic communication with the engagement sensing system 120, as described above. At block 508, the communication device 140 transmits the engagement parameter 50 to an application 255 installed on a user device 200 in wireless communication with the communication device 140. In an embodiment, the wireless communication may be Bluetooth as described above. The user device 200 may transmit the engagement parameter 50 to the manager device 300. The method 500 may further include: detecting, using the application 255 installed on the user device 200, a location parameter 57 of the user device 200. As mentioned above, the location parameter 57 may be used to determine whether the user device 200 is at a job site and/or whether the user device 200 is within an elevator shaft.

An alarm 259 may activate on the user device 200 when the engagement parameter 50 is received. The alarm 259 may only activate when the engagement parameter 50 indicates that the elevator door wedge 100 is not properly engaged. Also, the alarm 259 may only activate when the location parameter 57 indicates that the user device 200 is within a selected radius of a selected location and the elevator door wedge 100 is not properly engaged. An alarm 359 may activate on the manager device 300 when the engagement parameter 50 is received. The alarm 359 may only activate when the engagement parameter 50 indicates that the elevator door wedge 100 is not properly engaged. Also, the alarm 359 may only activate when the location parameter 57 indicates that the user device 200 is within a selected radius of a selected location and the elevator door wedge 100 is not properly engaged.

The engagement parameter 50 may be displayed on either the user device 200 or the manager device 300 as an elevator door wedge status 440, as described above. The color of the door wedge status 440 may also change in response to the engagement parameter 50. It is important to note that text may be utilized for the door wedge status 440 in lieu of a symbol, as shown in FIG. 3. The method 500 may further include: displaying, using the application 255 installed on the user device 200, instructions 450, 460 in response to the engagement parameter 50, the instructions 450, 460 depicting proper engagement of an elevator door wedge 100 and an elevator door 20. The instructions are at least one or audio, video, and textual While the above description has described the flow process of FIG. 4 in a particular order, it should be appreciated that unless otherwise specifically required in the attached claims that the ordering of the steps may be varied.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An elevator door wedge monitoring system comprising:

an engagement sensing system comprising an engagement arm, the engagement sensing system being configured to detect an engagement parameter, wherein the engagement parameter indicates whether an elevator door wedge is properly engaged with an elevator door by detecting a distance between an upper jaw of the elevator door wedge and the engagement arm of the engagement sensing system;

a communication device in electronic communication with the engagement sensing system and configured to receive the engagement parameter from the engagement sensing system; and an application installed on a user device in wireless communication with the communication device;

wherein the communication device is configured to transmit the engagement parameter to the application.

2. The elevator door wedge monitoring system of claim 1, wherein:

the wireless communication is Bluetooth.

3. The elevator door wedge monitoring system of claim 1, wherein:

the application on the user device is configured to transmit the engagement parameter to an application on a manager device.

4. The elevator door wedge monitoring system of claim 1, wherein:

the application on the user device is configured to activate an alarm on the user device when the engagement parameter indicates that the elevator door wedge is not properly engaged.

5. The elevator door wedge monitoring system of claim 1, wherein:

the application on the user device is configured to detect a location parameter of the user device.

6. The elevator door wedge monitoring system of claim 5, wherein:

the application on the user device is configured to activate an alarm on the user device when the location parameter is within a selected radius of a selected location and the engagement parameter indicates that the elevator door wedge is not properly engaged.

7. The elevator door wedge monitoring system of claim 1, wherein:

the application on the user device is configured to display an elevator door wedge status in response to the engagement parameter.

8. The elevator door wedge monitoring system of claim 3, wherein:

the application on the manager device is configured to display an elevator door wedge status in response to the engagement parameter.

9. The elevator door wedge monitoring system of claim 1, wherein:

the application on the user device is configured to display instructions in response to the engagement parameter, the instructions depicting proper engagement of the elevator door wedge and the elevator door.

10. The elevator door wedge monitoring system of claim 3, wherein:

the application on the manager device is configured to activate an alarm on the manager device when the engagement parameter indicates that the elevator door wedge is not properly engaged.

11. A method of monitoring elevator door wedge usage, the method comprising:

detecting, using an engagement sensing system, an engagement parameter, the engagement sensing system comprising an engagement arm, wherein the engagement parameter indicates whether the elevator door wedge is properly engaged with an elevator door by detecting a distance between an upper jaw of the elevator door wedge and the engagement arm of the engagement sensing system;

receiving, using a communication device, the engagement parameter from the engagement sensing system, the communication device being in electronic communication with the engagement system; and transmitting, using the communication device, the engagement parameter to an application installed on a user device in wireless communication with the communication device.

12. The method of claim 11, further comprising:

transmitting, using the application installed on the user device, the engagement parameter to an application installed on a manager device.

13. The method of claim 11, further comprising:

activating, using the application installed on the user device, an alarm on the user device when the engagement parameter indicates that the elevator door wedge is not properly engaged.

14. The method of claim 11, further comprising:

detecting, using the application installed on the user device, a location parameter of the user device.

15. The method of claim 14, further comprising:

activating, using the application installed on the user device, an alarm on the user device when the location parameter is within a selected radius of a selected location and the engagement parameter indicates that the elevator door wedge is not properly engaged.

16. The method of claim 11, further comprising:

displaying, using the application installed on the user device, an elevator door wedge status in response to the engagement parameter.

17. The method of claim 12, further comprising:

displaying, using the application installed on the manager device, an elevator door wedge status in response to the engagement parameter.

18. The method of claim 11, further comprising:

displaying, using the application installed on the user device, instructions in response to the engagement parameter, the instructions depicting proper engagement of the elevator door wedge and the elevator door.

19. The method of claim 12, further comprising:

activating, using the application installed on the manager device, an alarm on the manager device when the engagement parameter indicates that the elevator door wedge is not properly engaged.

20. An elevator door wedge comprising:

an upper jaw;

a lower jaw operably connected to the upper jaw;

an adjustment mechanism configured to adjust a distance between the upper jaw and the lower jaw;

an engagement sensing system comprising an engagement arm, the engagement sensing system being configured to detect an engagement parameter, wherein the engagement parameter indicates whether an elevator door wedge is properly engaged with an elevator door by detecting a distance between the upper jaw of the elevator door wedge and the engagement arm of the engagement sensing system; and a communication device in electronic communication with the engagement sensing system and configured to receive the engagement parameter from the engagement sensing system.

* * * * *